US010160024B2

(12) United States Patent
Tomaru et al.

(10) Patent No.: US 10,160,024 B2
(45) Date of Patent: Dec. 25, 2018

(54) DEEP-DRAWING METHOD AND FORMING DIE THEREFOR

(71) Applicant: TOYO SEIKAN GROUP HOLDINGS, LTD., Tokyo (JP)

(72) Inventors: Hidekazu Tomaru, Yokohama (JP); Nobuhisa Okabe, Yokohama (JP); Hironori Oonishi, Mihara (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 195 days.

(21) Appl. No.: 14/399,053

(22) PCT Filed: Jun. 5, 2013

(86) PCT No.: PCT/JP2013/065535
§ 371 (c)(1),
(2) Date: Apr. 3, 2015

(87) PCT Pub. No.: WO2013/183657
PCT Pub. Date: Dec. 12, 2013

(65) Prior Publication Data

US 2015/0217357 A1 Aug. 6, 2015

(30) Foreign Application Priority Data

Jun. 7, 2012 (JP) ..... 2012-130163

(51) Int. Cl.
*B21D 22/22* (2006.01)
*B21D 24/04* (2006.01)
(Continued)

(52) U.S. Cl.
CPC ..... *B21D 24/04* (2013.01); *B21D 22/02* (2013.01); *B21D 22/06* (2013.01); *B21D 22/22* (2013.01);
(Continued)

(58) Field of Classification Search
CPC ..... B21D 22/22; B21D 24/04; B21D 25/00; B21D 22/02; B21D 22/06; B21D 24/06; B21D 51/26
(Continued)

(56) References Cited

U.S. PATENT DOCUMENTS 2,681,630 A * 6/1954 Hempel ..... B21D 22/22 72/350
4,615,205 A * 10/1986 Ragland, Jr. ..... B21D 22/02 445/47
(Continued)

FOREIGN PATENT DOCUMENTS

DE 666565 C1 10/1938
JP 47-8131 B 3/1972
(Continued)

OTHER PUBLICATIONS

Machine translation of DE666565 (IDS).*
(Continued)

*Primary Examiner* — David B Jones
(74) *Attorney, Agent, or Firm* — Westerman, Hattori, Daniels & Adrian, LLP

(57) ABSTRACT

The present invention provides a deep-drawing method and a forming die therefor which can prevent the occurrence of cup side wall wrinkles and the collapse of the bottom during the process of deep-drawing a blank and which can increase the drawing ratio. A wrinkle pressing surface of a pressure pad (1) or an upper surface of a draw die (2) includes a flat inner edge surface (11), a tapered surface (12) which becomes deeper as the surface advances from the flat inner edge surface toward an outer circumference, a deepest flat surface (13), and a flat outer edge surface (14), which are provided in that order from an inner edge through which a draw punch passes toward an outer edge.

12 Claims, 3 Drawing Sheets

(51) Int. Cl.

| | |
|---|---|
| ***B21D 22/06*** | (2006.01) |
| ***B21D 24/06*** | (2006.01) |
| ***B21D 22/02*** | (2006.01) |
| ***B21D 25/00*** | (2006.01) |
| *B21D 51/26* | (2006.01) |

(52) U.S. Cl.
CPC ..... *B21D 24/06* (2013.01); *B21D 25/00* (2013.01); *B21D 51/26* (2013.01)

(58) Field of Classification Search
USPC ..... 72/350, 351
See application file for complete search history.

(56) References Cited

U.S. PATENT DOCUMENTS

| | | | | |
|---|---|---|---|---|
| 5,176,021 | A * | 1/1993 | Jensen | B21D 22/22 279/3 |
| 9,327,332 | B2 * | 5/2016 | Flehmig | B21D 22/22 |
| 2005/0217344 | A1 * | 10/2005 | Losch | B21D 22/22 72/351 |
| 2006/0137422 | A1 * | 6/2006 | Kodaka | B21D 24/04 72/350 |
| 2011/0094283 | A1 | 4/2011 | Flehmig et al. | |
| 2011/0100085 | A1 * | 5/2011 | Kubo | B21D 22/22 72/350 |

FOREIGN PATENT DOCUMENTS

| | | |
|---|---|---|
| JP | 60-146524 U | 9/1985 |
| JP | 2002-192251 A | 7/2002 |

OTHER PUBLICATIONS

Human translation of JP1985146524U (IDS).*
International Search Report dated Aug. 27, 2013, issued in corresponding application No. PCT/JP2013/065535.
Written Opinion of the International Searching Authority dated Aug. 27, 2013, issued in corresponding application No. PCT/JP2013/065535.

* cited by examiner

COMPARATIVE EXAMPLE 5

COMPARATIVE EXAMPLE 7

DEEP-DRAWING METHOD AND FORMING DIE THEREFOR

TECHNICAL FIELD

The present invention relates to a deep-drawing method and forming die for deep-drawing a metal can or the like, and more particularly, to a deep-drawing method and forming die preventing forming defects such as cup side wall wrinkles or the collapse of the bottom.

BACKGROUND ART

In processes of obtaining a metal container such as a seamless can, a cup is formed from a flat sheet material (blank) according to deep-drawing and the obtained cup is redrawn or subjected to redrawing and ironing to obtain a seamless can. The deep-drawing is realized in such a way that a draw punch squeezes a blank into a draw die in a state where the blank is clamped between a pressure pad (also referred to as a blank holder, a draw pad or the like) and the upper surface of the draw die. However, in this case, when the deep-drawing progresses, wrinkles are occurred in the blank and the wrinkles may remain on the side walls of a formed cup unless the wrinkles are suppressed by the pressure pad and the draw die. If wrinkle pressing pressure is increased to suppress the occurrence of wrinkles, large tension acts on the cup during the deep-drawing and the bottom of the cup may collapse easily. Such a phenomenon becomes remarkable as the drawing ratio increases. Although the drawing ratio is naturally limited depending on materials, various attempts have been proposed to suppress the occurrence of wrinkles and the collapse of the bottom and to improve the drawing ratio by modifying the pressure pad in order to perform deep-drawing satisfactorily.

Although a pressing surface of a pressure pad is generally formed as a flat surface, for example, a technique of forming a concentric ring-shaped groove on the pressing surface to form the pressing surface into a concavo-convex shape, forming small wrinkles intentionally in the ring-shaped groove in a drawing process to generate appropriate tension in a blank member by allowing the wrinkles to be hooked on a transitional portion of the concavo-convex shape to thereby prevent the occurrence of large wrinkles and pinching has been proposed (Patent document 1).

Moreover, a technique of forming a concave portion in a pressure pad to form the pressing surface of the concave portion as a tapered surface which becomes deeper as the surface advances toward an outer circumference has been proposed (Patent document 2).

However, both techniques are not satisfactory enough to suppress wrinkles occurred or to prevent the collapse of the bottom in the blank at the initial stage of the forming when a thin base metal sheet is deep-drawn with a high drawing ratio.

Moreover, seamless cans are also manufactured using a resin-coated metal sheet in which one or both surfaces of a metal base is coated with a resin such as a polyester resin. However, in the case of positive pressure cans, since the metal sheet is thin and the blank diameter is small, such cans may be generally obtained through deep-drawing one round of redrawing and a plurality of rounds of ironing and the number of processes required for obtaining the diameter of a final can is small.

On the other hand, in the case of negative pressure cans, since the metal sheet is thick and the blank diameter is large as compared to positive pressure cans, the number of redrawing processes required for obtaining the diameter of a final can increase and a multi-process press machine is used. However, the productivity is poor and the facility and die costs are high, and die exchange require a lot of time.

Moreover, although the number of processes can be reduced when the drawing ratio in deep-drawing and redrawing processes are increased, if the drawing ratio is simply increased forming defects such as cup side wall wrinkles or the collapse of the bottom occur.

Further, in recent years, there is a demand for decreasing the thickness of a base sheet from the perspective of weight reduction, and as a result, forming defects such as cup side wall wrinkles or the collapse of the bottom are likely to occur during deep-drawing. Thus, it is desirable to prevent such forming defects when a thin metal sheet such as tin-free steel is deep-drawn.

CITATION LIST

Patent Document

Patent Document 1: Japanese Patent Application Publication No. 2002-192251

Patent Document 2: Japanese Utility Model Application Publication No. S60-146524

SUMMARY OF INVENTION

Problem to be Solved by the Invention

The present invention has been made in view of the above circumstances, and an object thereof is to provide a deep-drawing method and forming die therefor capable of preventing forming defects such as cup side wall wrinkles or the collapse of the bottom due to deep-drawing of a blank when manufacturing a metal container such as a seamless can, increasing the drawing ratio during the deep-drawing as compared to the conventional one, and reducing the number of processes when manufacturing a metal container such as a seamless can.

Means for Solving Problem

In order to attain the object, the present invention provides a forming die for deep-drawing a blank into a cup, the forming die including a draw punch, a draw die, and a pressure pad wherein a wrinkle pressing surface of the pressure pad or an upper surface of the draw die is formed of a flat inner edge surface, a tapered surface that becomes deeper as the surface advances from the flat inner edge surface toward an outer circumference, and a flat outer edge surface, which are provided in that order from an inner edge through which the draw punch passes toward an outer edge.

In the forming die it is preferable that an area of the flat outer edge surface is 11% to 31% of an entire area of the wrinkle pressing surface of the pressure pad when calculated assuming that the wrinkle pressing surface is a flat surface.

In the forming die an inner-outer flat surface step may be provided so that the flat outer edge surface is more convex than the flat inner edge surface.

In the forming die it is preferable that a taper angle of the tapered surface is 0°1' to 0°6', and a step of 0.005 mm to 0.013 mm is created between a deepest portion of the tapered surface and the flat inner edge surface.

In order to attain the object, the present invention provides a deep-drawing method for forming a blank into a cup using a draw punch while holding the blank using a pressure pad and a draw die, wherein a wrinkle pressing surface of the pressure pad or an upper surface of the draw die is formed of a flat inner edge surface, a tapered surface that becomes deeper as the surface advances from the flat inner edge surface toward an outer circumference, and a flat outer edge surface, which are provided in that order from an inner edge through which the draw punch passes toward an outer edge, the blank is pressed and held by the flat inner edge surface and the flat outer edge surface when deep drawing starts, the occurrence of wrinkles in the tapered portion is allowed in an initial stage of deep-drawing and when the deep-drawing progresses and the pressing of the flat outer edge surface is released, the wrinkles in the blank is disappear with the tapered surface and the flat inner edge surface.

It is preferable that, in the deep-drawing method, an outer circumference portion of the blank is pressed and held even when the outer circumference portion passes through the tapered portion after the pressing of the flat outer edge surface of the pressure pad is released.

Advantageous Effects of Drawings

According to the forming die of the present invention, although small wrinkles are formed in a concave portion formed by the tapered surface after the drawing starts, the wrinkles do not spread but disappear even when drawing progresses. Moreover, it is possible to obtain the effect of suppressing the collapse of the bottom, to extend a formable range, and to obtain deep-drawn cups with a high drawing ratio even when the raw sheet thickness is thinned (down gauged) as compared to the conventional one.

Moreover, since the area of the flat outer edge surface is in the range of 11% to 31% of the entire area of the wrinkle pressing surface, it is possible to effectively clamp and hold the outer circumference portion of the blank at the stat of the deep-drawing to prevent the collapse of the bottom.

Further, since the inner-outer flat surface step is formed, the outer circumference portion of the blank is clamped in the initial stage of the deep-drawing but is not clamped in the concave portion formed from the intermediate tapered surface. Thus, concentration of load on the flat inner edge surface is suppressed and the collapse of the bottom is prevented.

Further, in the forming die the taper angle of the tapered surface and the step between the deepest portion of the tapered surface and the flat inner edge surface are in the above-described ranges. Thus, the outer circumference portion of the blank is effectively clamped even after the outer circumference portion has escaped the flat outer edge surface, and it is possible to effectively prevent spreading of the minute wrinkles and the collapse of the bottom.

According to the deep-drawing method of the present invention, it is possible to effectively prevent the occurrence of forming defects such as cup side wall wrinkles or the collapse of the bottom in the process of deep drawing a blank and to increase the drawing ratio. Thus, it is possible to reduce the number of processes when manufacturing a metal container such as a seamless can and to improve the productivity. Moreover, since the forming defects such as cup side wall wrinkles or the collapse of the bottom are prevented and stable drawing can be performed even when the base sheet thickness is thinned (down gauged) it is possible to reduce the weight of the metal container such as a seamless can.

In the deep-drawing method, the outer circumference portion of the blank is pressed and held even when the outer circumference portion passes through the tapered portion after the pressing of the flat outer edge surface of the pressure pad is released. Thus, it is possible to prevent the spreading of the minute wrinkles and to effectively prevent the collapse of the bottom.

EXPLANATION OF REFERENCE NUMERALS

Figure 1:
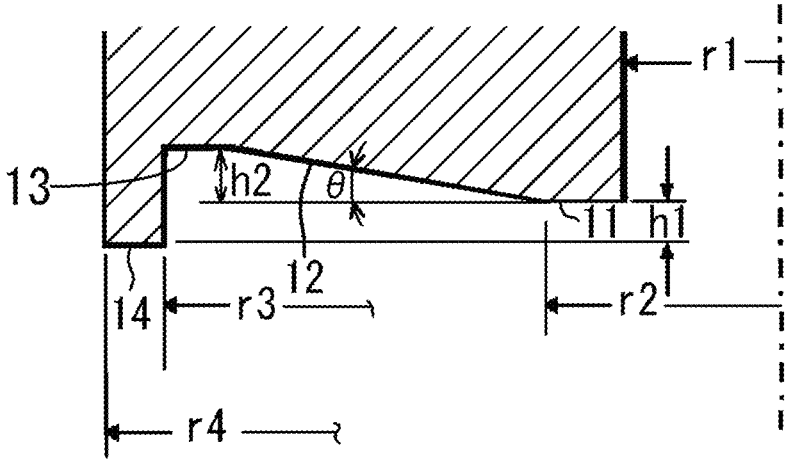
FIG. 1 is a cross-sectional view of major portions of a pressure pad according to an embodiment of the present invention.

1, 30, 40, 50, 60: pressure pad
2, 45, 65: Draw die
3: Draw punch
4: Blank
5: Outer circumference portion of blank
7: Forming acting surface (Die radius)
8: Draw punch acting surface (Punch radius)
11, 51: Flat inner edge surface
12, 52: Tapered surface
13: Deepest flat surface (Step surface)
14: Flat outer edge surface
15: Concave portion
62: Bead

DESCRIPTION OF EMBODIMENTS

Hereinafter, embodiments of the present invention will be described in detail based on drawings.

FIG. 1 illustrates a cross-section of major portions of a pressure pad according to an embodiment of the present invention.

Figure 2A:
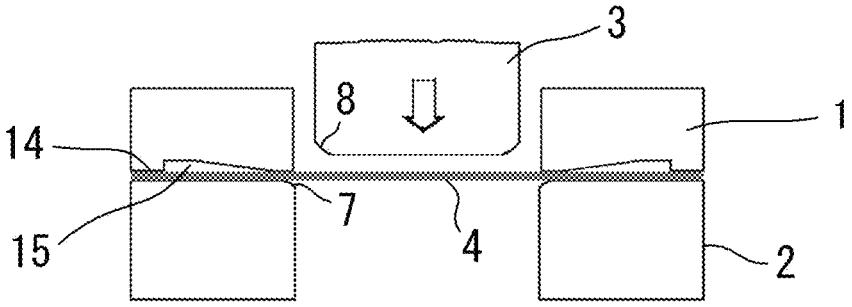
FIG. 2 are process diagrams of a deep-drawing method according to the present invention, in which (a) illustrates the state before drawing starts, (b) illustrates an initial state of the drawing and (c) illustrates an intermediate state of the drawing.
Figure 2B:
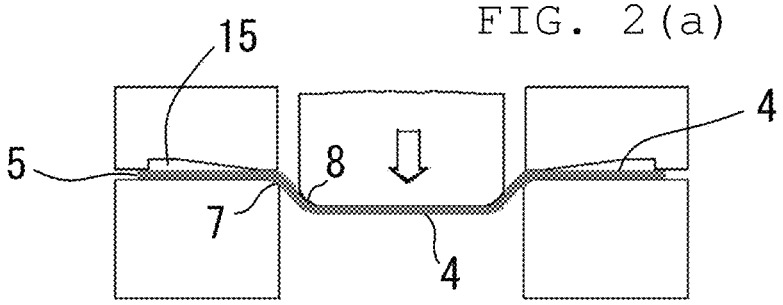

As illustrated in FIG. 2, a pressure pad 1 has an annular shape and is disposed concentrically about an annular draw die 2 and a cylindrical draw punch 3 similarly to general deep-drawing. The pressure pad 1 is configured to move closer to or away from the draw die 2 to press and hold a blank 4 under certain load between a upper surface of the draw die and the lower surface of the pressure pad. In the present embodiment, the draw die 2 is fixed, the pressure pad 1 moves downward so that the blank 4 is pressed and held under certain wrinkle pressing load between the upper surface (annular flat surface) of the draw die and the lower surface of the pressure pad and the draw punch 3 moves downward to enter the inner space of the draw die 2 whereby the blank 4 is drawing. However, such an arrangement relation may be reverse and is not necessarily limited to the present embodiment.

The pressure pad 1 has a cylindrical space having an inner edge diameter of r1 in a central portion thereof such that at least the draw punch 3 can enter the space and the blank can move along an outer circumferential surface of the draw punch with the downward movement of the draw punch 3. The surface shape of the pressure pad is formed of a flat inner edge surface 11, a tapered surface 12 that becomes deeper as the surface advances from the flat inner edge surface 11 toward an outer circumference, and a deepest flat surface (step surface) 13 and a flat outer edge surface 14 of the tapered surface, which are provided in that order from an inner edge through which the draw punch 3 passes toward an outer edge.

The flat inner edge surface 11 is an annular flat surface formed between the inner edge diameter r1 and a taper starting diameter r2. It is preferable that the flat inner edge surface 11 is as narrow as possible in order to effectively suppress wrinkles along a thickness distribution (the thickness increases as it advances from the inner side toward the outer side) of the blank during the deep-drawing.

Figure 2C:
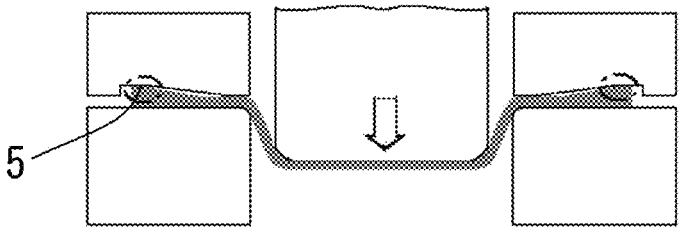

The tapered surface 12 preferably has such a shape that development of wrinkles in the blank 4 which is released from the state of being pressed by the flat outer edge surface 14 described later, the taper angle θ approximates to the thickness distribution of the blank during the drawing and the outer circumference portion 5 of the blank 4 preferentially makes contact with the tapered surface 12 as indicated by a broken-line ellipse in FIG. 2*c*. Thus, an optimal angle of the tapered surface 12 is different depending on a material, a thickness, and a outer diameter of the blank and a punch diameter. If the taper angle θ is large and the step formed in relation to the flat inner edge surface 11 is too large, since the outer circumference portion 5 of the blank 4 is not pressed and held after the outer circumference portion 5 has escaped the flat outer edge surface 14, a large wrinkle is formed in the concave portion. This step surface 13 is a horizontal annular flat surface that extends outward from the deepest portion of the tapered surface 12 and is a step surface having a height of h2 in relation to the flat inner edge surface 11. Although the step surface 13 is optional, the step surface 13 is effective in satisfactorily clamping the outer circumference portion 5 of the blank 4 which is released from the state of being pressed by the flat outer edge surface 14 to thereby suppress the spreading wrinkles. As described above, although the taper angle θ of the tapered surface 12 is different depending on the material, thickness, and diameter of the blank 4, the taper angle θ is preferably in the range of 0°1' to 0°6', and the step h2 between the deepest portion of the tapered surface 12 and the inner side surface is preferably set in the range of 0.005 mm to 0.013 mm.

The flat outer edge surface 14 is an annular flat surface formed between a flat outer edge surface starting diameter r3 and a wrinkle pressing diameter r4 which is approximately the same as the blank diameter and is configured to press the outer circumference portion of the blank 4 up to certain stroke in the initial stage of deep-drawing to apply tension to the blank 4. The flat outer edge surface 14 performs the action of preventing the occurrence of excessively large wrinkles in the concave portion formed between the tapered surface 12 and the step surface 13 in the initial stage of deep-drawing. Moreover, the flat outer edge surface 14 is formed as a slightly convex surface with an inner-outer flat surface step h1 on the outer side than the flat inner edge surface 11 so that load does not concentrate on the flat inner edge surface 11 at the start of drawing.

The area of the flat outer edge surface 14 is preferably 11% to 31% of the entire area of the wrinkle pressing surface when calculated assuming that the wrinkle pressing surface of the pressure pad 1 is a flat surface. If the area of the flat outer edge surface 14 is smaller than 11% of the entire area of the wrinkle pressing surface, the blank holding period in the flat outer edge surface 14 decreases and the collapse of the bottom is likely to occur. On the other hand, the area of the flat outer edge surface 14 exceeds 31% of the entire area of the wrinkle pressing surface, many wrinkles are occurred in the concave portion 15.

Processes of obtaining a cup from the disk-shaped blank 4 according to deep-drawing using the pressure pad 1 of the embodiment having such a configuration will be described based on FIG. 2.

As illustrated in FIG. 2(*a*) the blank 4 punched in a disk shape is pressed and held under predetermined wrinkle pressing load between the upper surface of the draw die 2 and the lower surface of the pressure pad 1. When the draw punch 3 moves downward, the blank 4 is pushed into the cavity of the draw die 2 and is subjected to bending by a forming acting surface (die radius) 7 of the draw die 2. In this way, drawing progresses. In this case, an annular portion of the blank 4 clamped between the upper surface of the draw die and the lower surface of the pressure pad 1 is stretched in a radial direction while receiving compressive force in the circumferential direction. With this compressive force, wrinkles are occurred in the annular portion of the blank 4. However, the occurrence of wrinkles is suppressed by the wrinkle pressing surface clamping the annular portion. In the case of a conventional flat wrinkle pressing surface, when the thickness distribution of the blank in wrinkle pressing region changes with the progress of drawing, wrinkles are formed on the inner side where a void is formed. The wrinkle pressing surface of the present embodiment has a small inner-outer flat surface step h1 between the inner and outer flat surfaces and the tapered concave portion 15 between the flat inner edge surface 11 and the flat outer edge surface 14. Thus, in an initial stage of deep-drawing where the state illustrated in FIG. 2(*a*) transitions to the state illustrated in FIG. 2(*b*), since the outer circumference portion 5 of the blank 4 moves while being pressed with predetermined pressure mainly by the flat outer edge surface 14, the blank 4 receives strong tensile load and the occurrence of wrinkles is suppressed. Conventionally, in the initial stage of deep-drawing the entire blank 4 is pressed and held, and strong tensile load is generated between the forming or the draw die acting surface 7 and the draw punch acting surface (punch radius) 8. However, according to the present embodiment, in the initial stage of drawing since the outer circumference portion 5 of the blank 4 is preferentially pressed and held by the inner-outer flat surface step h1 and is not pressed and held in the concave portion 15, the tensile load between the draw die acting surface 7 and the draw punch acting surface 8 is relieved, and the collapse of the bottom is prevented.

As illustrated in FIG. 2(*c*), when the outer circumference portion 5 of the blank 4 escapes the flat outer edge surface 14 to reach the region of the concave portion 15, the state in which the outer circumference portion 5 of the blank 4 is pressed and held by the flat outer edge surface 14 is released, and wrinkles are likely to be occurred in the outer circumference portion 5 of the blank 4 positioned in the concave portion 15. In contrast, in the present embodiment, in order to prevent the occurrence of wrinkles, even after the outer circumference portion 5 of the blank 4 escapes the flat outer edge surface 14, the outer circumference portion 5 is slightly pressed and held and the pressing and holding state is not released completely. That is, the concave portion 15 is formed into such a shape that is approximate to the thickness distribution of the blank 4 during the drawing and the tapered surface 12 having a very small angle and the deepest flat surface 13 continuous thereto are formed so that the outer circumference portion 5 of the blank 4 indicated by a one-dot-chain line ellipse in FIG. 2(*c*) makes contact with the upper and lower surfaces of the concave portion 15 so as to be clamped. With such a configuration, the occurrence of large wrinkles is suppressed, and the concentration of load on the flat inner edge surface 11 after the outer circumference portion 5 of the blank 4 escapes the flat outer edge surface 14 is relieved as compared to the conventional technique, and the collapse of the bottom is prevented.

Figure 3:
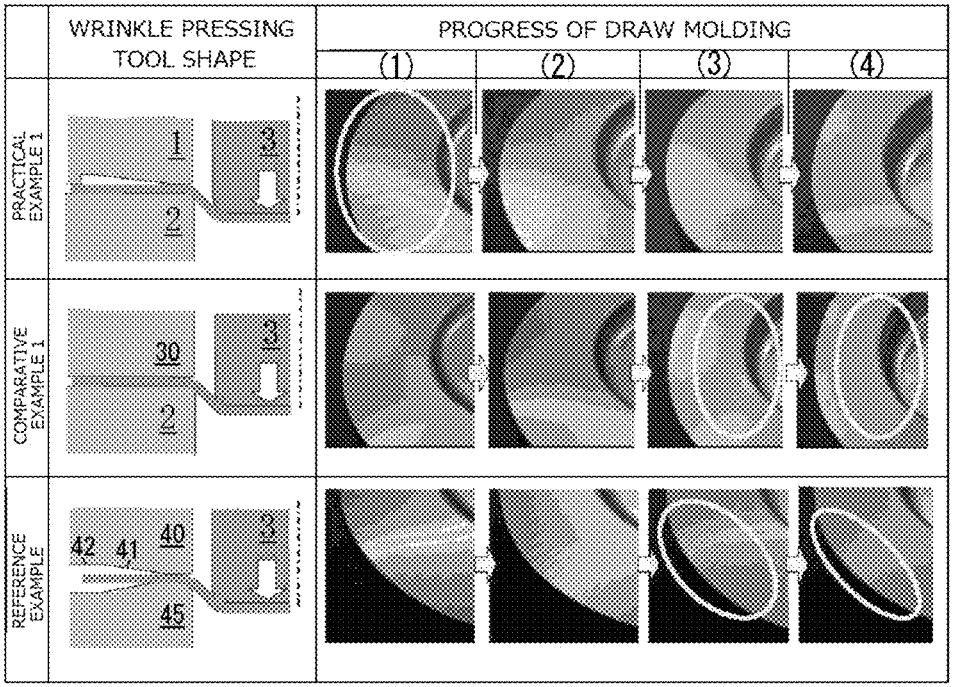
FIG. 3 illustrates pictures showing the state of wrinkles with the progress of drawing according to a practical example, a comparative example, and a reference example according to the present invention.

In this case, small wrinkles occurring when suppressing the large wrinkles disappear when the wrinkles pass the flat inner edge surface 11, and as illustrated in pictures of practical examples in FIG. 3, a shallow cup is satisfactorily deep-drawn without causing forming defects such as cup side wall wrinkles or the collapse (rupture) of the bottom.

EXAMPLES

Practical Example 1

A clear PET film having a thickness of 0.017 mm and a white PET film having a thickness of 0.013 mm containing white pigment made from a titanium oxide were laminated on both surfaces of a tin-free steel material (SR material: single roll of cold-rolled steel) having a thickness of 0.185 mm to obtain a resin-coated metal sheet.

Deep-drawing was performed using the resin-coated metal sheet and the wrinkle pressing die described below under the following forming conditions so that the clear PET film was on the inner surface, and the range of formable wrinkle pressing load was checked.

1. Evaluation Method
   ○: Draw formable
   Δ: Cup side wall wrinkle
   ×: Collapse of bottom
   ⊗: Peeling of film on cup opening end
2. Pressure Pad (See Practical Example 1 in FIG. 3)
   Taper angle θ: 0°1'38"
   Step h2: 0.007 mm
   Taper starting diameter r2: 80.7 mm
   Flat outer edge surface starting diameter r3: 136.6 mm
   Inner-outer flat surface step h1: 0.007 mm
   Flat outer edge surface area: 1405 $mm^2$
3. Forming Conditions
   Blank diameter: 143.0 mm
   Drawing ratio: 2.0
   Drawn cup diameter (draw punch diameter): 73 mm
   Draw punch radius Rp: 6.0 mm
   Draw die radius Rd: 2.0 mm
   Drawing clearance CL: 0.350 mm
   Forming speed: 10 spm
   Wrinkle pressing load (kN): 23 to 50

Comparative Example 1

Deep-drawing was performed similarly to Practical Example except that the conventional pressure pad 30 (the entire wrinkle pressing surface area: 11319 $mm^2$) (see Comparative Example 1 in FIG. 3) of which the wrinkle pressing surface is a flat surface was used, and the range of formable wrinkle pressing load was checked.

Practical Example 2

Deep-drawing was performed similarly to Practical Example 1 except that a tin-free steel material (SR material) having a thickness of 0.240 mm was used, and the range of formable wrinkle pressing load was checked.

Comparative Example 2

Deep-drawing was performed similarly to Comparative Example 1 except that a tin-free steel material (SR material) having a thickness of 0.240 mm was used, and the range of formable wrinkle pressing load was checked.

Practical Example 3

Deep-drawing was performed similarly to Practical Example except that the drawing ratio was 1.8 and the drawn cup diameter was 78 mm, and the range of formable wrinkle pressing load was checked.

Comparative Example 3

Deep-drawing was performed similarly to Comparative Example 1 except that the drawing ratio was 1.8 and the drawn cup diameter was 78 mm, and the range of formable wrinkle pressing load was checked.

Practical Example 4

Deep-drawing was performed similarly to Practical Example 3 except that a tin-free steel material (SR material) having a thickness of 0.240 mm was used, and the range of formable wrinkle pressing load was checked.

Comparative Example 4

Deep-drawing was performed similarly to Comparative Example 3 except that a tin-free steel material (SR material) having a thickness of 0.240 mm was used, and the range of formable wrinkle pressing load was checked.

Reference Example

Deep-drawing was performed similarly to Practical Example 1 using the pressure pad 40 in which a flat surface 42 extends from the deepest portion of the tapered surface 41 to the outer circumferential surface and the taper angle θ is 0°2'18", the taper starting diameter r2 is 96.3 mm, and the step h2 is 0.010 mm, and which does not have a flat outer edge surface and the draw die 45 of which the upper surface has a shape approximately symmetrical to the wrinkle pressing surface of the pressure pad 40 (see Reference Example in FIG. 3).

The results of observation on the occurrence of wrinkles with progress of deep-drawing according to Practical Example 1, Comparative Example 1, and Reference Example.

The results of Practical Example 1 showed that wrinkles occurred at the start of drawing but did not develop and disappeared at the end of drawing On the other hand, in Comparative Example 1, when drawing progressed and the thickness distribution of the blank in the wrinkle pressing region changed, wrinkles occurred in the inner side where a void was formed between the wrinkle pressing surface and the blank, and cup side wall wrinkles were observed at the end of drawing.

In Reference Example, wrinkles on the outer edge developed with the progress of drawing and remained without disappearing completely, and cup side wall wrinkles were observed at the end of drawing similarly to Comparative Example 1.

Comparative Example 5

Figure 4A:
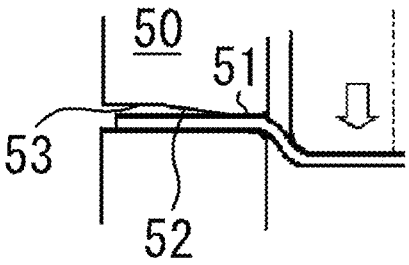
FIG. 4 are schematic cross-sectional views illustrating the shape of a pressure pad and a draw die in a state of holding a blank in an initial state of drawing according to comparative examples, in which (a) illustrates Comparative Example 5 and (b) illustrates Comparative Example 7.
Figure 4B:
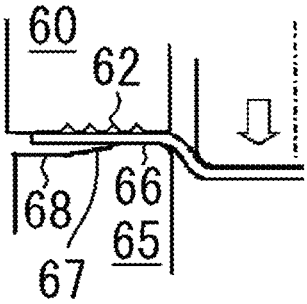

Deep-drawing was performed similarly to Practical Example using a pressure pad 50 in which the wrinkle pressing surface has such a shape that is formed of a flat inner edge surface 51 illustrated in FIG. 4(*a*), a tapered surface 52 that becomes deeper as the surface advances from the flat inner edge surface toward the outer side, and a flat surface 53 extending from a deepest portion of the tapered surface up to the outer circumferential edge and in which the taper angle θ is 0°2'18", the taper starting diameter r2 is 96.3 mm, and the step h2 between the flat inner edge surface 51 and the flat surface 53 is 0.010 mm, and the range of formable wrinkle pressing load was checked.

Comparative Example 6

Deep-drawing was performed similarly to Comparative Example 5 except that the taper angle θ is 0°3'32", the taper starting diameter r2 is 90.3 mm, and the step h2 between the flat inner edge surface 51 and the flat surface 53 is 0.015 mm, and the range of formable wrinkle pressing load was checked.

Comparative Example 7

A pressure pad 60 having a wrinkle pressing surface having such a shape that four beads (concave portions) 62 having a depth of 0.10 mm are formed in a concentric form at a predetermined distance from an inner flat surface illustrated in FIG. 4(*b*) was used. Moreover, a draw die 65 having such a shape that an annular flat portion 66 having a predetermined width extending horizontally from a forming acting surface (corner portion) of an inner circumferential edge is formed, a tapered surface 67 having a taper angle θ of 0°2'18" is formed so as to extend for the outside lower part, and a flat surface extending from the deepest portion toward the outer circumferential surface is formed was used.

Deep-drawing was performed using the pressure pad 60, the draw die 65, and the same resin-coated metal sheet as used in Practical Example 1, and the range of formable wrinkle pressing load was checked.

Practical Example 5

Deep-drawing was performed similarly to Practical Example 1 except that a tin-free steel material (DR material: double roll of cold-rolled steel) having a thickness of 0.185 mm and the range of formable wrinkle pressing load was checked.

Comparative Example 8

Deep-drawing was performed similarly to Comparative Example 5 except that a tin-free steel material (DR material) having a thickness of 0.185 mm and the range of formable wrinkle pressing load was checked.

Comparative Example 9

Deep-drawing was performed similarly to Comparative Example 8 except that a tin-free steel material (DR material) having a thickness of 0.185 mm and the range of formable wrinkle pressing load was checked.

Table 1 illustrates the ranges of formable wrinkle pressing load of Practical Examples 1 to 4, and 5 and Comparative Examples 1 to 9.

TABLE 1

| | | Practical Example 1 | Comp. Example 1 | Practical Example 2 | Comp. Example 2 | Practical Example 3 | Comp. Example 3 | Practical Example 4 | Comp. Example 4 | Comp. Example 5 | Comp. Example 6 | Comp. Example 7 | Practical Example 5 | Comp. Example 8 | Comp. Example 9 |
|---|---|---|---|---|---|---|---|---|---|---|---|---|---|---|---|
| Metal sheet (mm) | | 0.185 (SR material) | | 0.240 (SR material) | | 0.185 (SR material) | | 0.240 (SR material) | | 0.185 (SR material) | | | 0.185 (DR material) | | |
| Drawing ratio | | 2.0 | | 2.0 | | 1.8 | | 1.8 | | 2.0 | | | 2.0 | | |
| Cup diameter (mm) | | 73 | | 73 | | 78 | | 78 | | 73 | | | 73 | | |
| Wrinkle pressing load (kN) | 23 | Δ | Δ | Δ | Δ | Δ | Δ | ○ | Δ | Δ | Δ | Δ | Δ | Δ | Δ |
| | 28 | Δ | Δ | ○ | Δ | Δ | Δ | ○ | ○ | Δ | Δ | ○ | Δ | Δ | Δ |
| | 33 | Δ | Δ | ○ | Δ | ○ | Δ | ○ | ○ | Δ | Δ | ⊗ | Δ | X | X |
| | 39 | ○ | Δ | ○ | ○ | ○ | Δ | ○ | ○ | Δ | X | ⊗ | Δ | X | X |
| | 45 | ○ | X | ○ | ○ | ○ | ○ | ○ | ○ | X | X | ⊗ | ○ | X | X |
| | 50 | ○ | X | ○ | ○ | ○ | ○ | ○ | ○ | X | X | X | ○ | X | X |

According to the results, when Practical Examples 1 to 4 and Comparative Examples 1 to 4 corresponding thereto are compared, it can be understood that the ranges of formable wrinkle pressing load of the practical examples are wide and that the range of wrinkle pressing load during deep-drawing is narrow as the thickness of the base metal sheet decreases and/or the drawing ratio increases. For example, when Practical Example 1 and Comparative Example 1 are compared, the forming die according to Practical Example 1 can satisfactorily forming form the 0.185 mm thick SR material in the range of wrinkle pressing load of 39 kN to 50 kN with a drawing ratio of 2.0 under the same forming conditions. However, the forming die of Comparative Example 1 could not achieve satisfactory deep-drawing under the same conditions even if the wrinkle pressing load was changed.

As for the shape of the pressure pad when the range of formable wrinkle pressing load is compared between Practical Example 1 and Comparative Examples 5 to 7, and between Practical Example 5 and Comparative Examples 8 and 9, it can be understood that the pressure pad shapes of the practical examples provide excellent deep-drawing properties.

In Comparative Example 7, the film on the cup opening end peeled off at wrinkle pressing load of 33 kN to 45 kN.

From the ranges of formable wrinkle pressing load of the practical examples, it can be understood that the DR material is more difficult than the SR material in realizing drawing satisfactorily while suppressing cup side wall wrinkles and the collapse of the bottom.

Tests for examining a preferred shape of a pressure pad based on the results of practical examples were conducted.

Test

Deep-drawing was performed using the resin-coated metal sheet of Practical Example 1 and the pressure pad in which the taper angle θ, the step h2, the taper starting diameter r2, the flat outer edge surface starting diameter r3, the inner-outer flat surface step h1, and the flat outer edge surface area ratio illustrated in Table 2 were changed in various ways so that the clear PET film was on the inner surface, and the range of formable wrinkle pressing load was checked.

In this case, the forming conditions were the same as those of Practical Example 1, and the flat surface area ratio to the entire area (11319 $mm^2$) of the wrinkle pressing surface of the conventional pressure pad 30 of Comparative Example 1 in which the wrinkle pressing surface is a flat surface was calculated.

Test Example 1 illustrates Practical Example 1.

Table 2 illustrates the test results.

TABLE 2

| | | Test Example 1 | Test Example 2 | Test Example 3 | Test Example 4 | Test Example 5 | Test Example 6 | Test Example 7 |
|---|---|---|---|---|---|---|---|---|
| Taper angle (θ) | | 0°1'38" | 0°1'43" | 0°1'42" | 0°1'5" | 0°2'5" | 0°3'1" | 0°5'5" |
| Step (h2) (mm) | | 0.007 | 0.008 | 0.010 | 0.005 | 0.010 | 0.013 | 0.013 |
| Taper starting diameter (r2) (mm) | | 80.7 | 82.7 | 79.6 | 81.8 | 85.8 | 82.4 | 89.4 |
| Flat outer edge surface starting diameter(r3) (mm) | | 136.6 | 131.8 | 129.3 | 137.2 | 126.9 | 128.0 | 137.0 |
| Inner-outer flat surface step (h1) (mm) | | 0.007 | 0.003 | 0.004 | 0.006 | 0 | 0 | 0 |
| Flat outer edge surface area ($mm^2$) | | 1405 | 2417 | 2930 | 1276 | 3413 | 3193 | 1319 |
| Flat outer edge surface area ratio (%) | | 12.4 | 21.4 | 25.9 | 11.3 | 30.2 | 28.2 | 11.7 |
| Wrinkle pressing load (kN) | 23 | Δ | Δ | Δ | Δ | Δ | Δ | Δ |
| | 28 | Δ | Δ | Δ | Δ | Δ | Δ | Δ |
| | 33 | ○ | Δ | Δ | ○ | Δ | ○ | ○ |
| | 39 | ○ | ○ | Δ | ○ | ○ | ○ | ○ |
| | 45 | ○ | ○ | ○ | ○ | ○ | X | X |
| | 50 | ○ | ○ | ○ | X | X | | |

As illustrated in Table 2, it was confirmed that the ranges of formable wrinkle pressing load of Test Examples 1 to 7 where cup side wall wrinkles and the collapse of the bottom do not occur were wide, which is obvious from comparison with Comparative Example 1 (deep-drawing under the same conditions as test examples) illustrated in Table 1.

In the test examples, it was confirmed that the range of wrinkle pressing load where satisfactory drawing can be realized widened when all ranges of the taper angle of 0°1'38" to 0°5'5", the step h2 of 0.005 mm to 0.013 mm, the taper starting diameter r2 of 79.6 mm to 89.4 mm, the flat outer edge surface starting diameter r3 of 126.9 mm to 137.2 mm, the inner-outer flat surface step h1 of 0 mm to 0.007 mm, and the flat outer edge surface area ratio of 11.3% to 30.2% were satisfied.

In the above ranges, a range of taper angles of 0°1' to 0°6' and flat outer edge surface area ratios of 11% to 31% are allowable.

In the practical examples and test examples, although deep-drawing of the metal sheet has been described, the present invention is not limited to the metal sheet but can be applied to deep-drawing of a blank which uses paper as its base material or a blank which uses a synthetic resin as its base material.

The flat inner edge surface formed on the wrinkle pressing surface of the pressure pad the tapered surface that becomes deeper as the surface advances from the flat inner edge surface toward the outer circumference, and the flat outer edge surface may be formed on the upper surface of the draw die. In this case, the wrinkle pressing surface of the pressure pad is formed as a flat surface. Alternatively, the surface having such a shape may be formed on both the pressure pad and the draw die.

INDUSTRIAL APPLICABILITY

According to the forming die and the forming method according to the present invention, the range of formable wrinkle pressing load is wide and the drawing ratio from the blank can be increased as compared to the conventional technique. By applying the present invention to deep-drawing of metal cans or resin-coated metal cans, in particular, it is possible to reduce the base sheet thickness, to simplify forming facilities, and to provide high industrial applicability. Moreover, the base material is not limited to a metal material, and the present invention can be also used for forming paper blanks and synthetic resin blanks.

The invention claimed is:

1. A forming die for deep-drawing a blank into a cup, said forming die comprising:

a columnar draw punch;

an annular draw die having an upper surface; and an annular pressure pad having a wrinkle pressing surface connecting an innermost edge and an outermost edge of the pressure pad, wherein the wrinkle pressing surface of the pressure pad comprises, in an order from the innermost edge toward outermost edge, a flat innermost edge surface, a tapered surface formed such that distance between the wrinkle pressing surface of the pressure pad and the upper surface of the draw die increases from the flat innermost edge surface toward the outermost edge, and a flat outermost edge surface to press the blank by the draw die and the pressure pad when deep-drawing starts, wherein the distance between the wrinkle pressing surface of the pressure pad and the upper surface of the draw die is made smaller at the flat outermost edge surface than at the flat innermost edge surface, and wherein the upper surface of the draw die is a flat surface.

2. The forming die according to claim 1, wherein an area of the flat outermost edge surface is 11% to 31% of an entire area of the wrinkle pressing surface of the pressure pad, and the wrinkle pressing surface is a flat surface comprising the flat innermost edge surface, the tapered surface, and the flat outermost edge surface.

3. The forming die according to claim 1, wherein a taper angle of the tapered surface is 0°1' to 0°6', and a step of 0.005 mm to 0.013 mm is created between a deepest portion of the tapered surface and the flat innermost edge surface.

4. The forming die according to claim 2, wherein a taper angle of the tapered surface is 0°1' to 0°6', and a step of 0.005 mm to 0.013 mm is created between a deepest portion of the tapered surface and the flat innermost edge surface.

5. A deep-drawing method for forming a blank into a cup, said method comprising:

holding the blank using a annular pressure pad having a wrinkle pressing surface connecting an innermost edge and an outermost edge of the pressure pad, and an annular draw die having an upper surface, and using a columnar draw punch to form the blank into the cup, wherein the wrinkle pressing surface of-the pressure pad comprises, in an order from the innermost edge toward the outermost edge, a flat innermost edge surface, a tapered surface formed such that distance between the wrinkle pressing surface of the pressure pad and the upper surface of the draw die increases from the flat innermost edge surface toward the outermost edge, and a flat outermost edge surface, and wherein the distance between the wrinkle pressing surface of the pressure pad and the upper surface of the draw die is made smaller at the flat outermost edge surface than at the flat innermost edge surface, and wherein the upper surface of the draw die is a flat surface, pressing the blank by the draw die and the pressure pad at the flat innermost edge surface and the flat outermost edge surface when deep-drawing starts, wherein occurrence of wrinkles is allowed in an initial stage of a deep-drawing, and releasing the pressing of the flat outermost edge when the deep-drawing progresses, wherein the wrinkles in the blank disappear while the blank pass through the tapered surface and the flat innermost edge surface.

6. The deep-drawing method according to claim 5, wherein an outer circumference portion of the blank is pressed and held even when the outer circumference portion passes through the tapered surface after the pressing of the flat outermost edge surface of the pressure pad is released.

7. A forming die for deep-drawing a blank into a cup, said forming die comprising:

a columnar draw punch;

an annular draw die having an upper surface connecting an innermost edge and an outermost edge of the draw die; and an annular pressure pad having a wrinkle pressing surface, wherein the upper surface of the draw die comprises, in an order from the innermost edge toward outermost edge, a flat innermost edge surface, a tapered surface formed such that distance between the wrinkle pressing surface of the pressure pad and the upper surface of the draw die increases from the flat innermost edge surface toward the outermost edge, and a flat outermost edge surface to press the blank by the draw die and the pressure pad when deep-drawing starts, wherein the distance between the wrinkle pressing surface of the pressure pad and the upper surface of the draw die is made smaller at the flat outermost edge surface than at the flat innermost edge surface, and wherein the wrinkle pressing surface of the pressure pad is a flat surface.

8. The forming die according to claim 7, wherein an area of the flat outermost edge surface is 11% to 31% of an entire area of the wrinkle pressing surface of the pressure pad, and the wrinkle pressing surface is a flat surface comprising the flat innermost edge surface, the tapered surface, and the flat outermost edge surface.

9. The forming die according to claim 7, wherein a taper angle of the tapered surface is 0°1' to 0°6', and a step of 0.005 mm to 0.013 mm is created between a deepest portion of the tapered surface and the flat innermost edge surface.

10. The forming die according to claim 8, wherein a taper angle of the tapered surface is 0°1' to 0°6', and a step of 0.005 mm to 0.013 mm is created between a deepest portion of the tapered surface and the flat innermost edge surface.

11. A deep-drawing method for forming a blank into a cup, said method comprising:

holding the blank using a annular pressure pad having a wrinkle pressing surface, and a annular draw die having an upper surface connecting an innermost edge and an outermost edge of the draw die, and using a columnar draw punch to form the blank into the cup, wherein the upper surface of the draw die comprises, in an order from the innermost edge toward an outermost edge, a flat innermost edge surface, a tapered surface formed such that distance between the wrinkle pressing surface of the pressure pad and the upper surface of the draw die increases from the flat innermost edge surface toward the outermost edge, and a flat outermost edge surface, and wherein the distance between the wrinkle pressing surface of the pressure pad and the upper surface of the draw die is made smaller at the flat outermost edge surface than at the flat innermost edge surface, and wherein the wrinkle pressing surface of the pressure pad is a flat surface, pressing the blank by the draw die and the pressure pad at the flat innermost edge surface and the flat outermost edge surface when deep-drawing starts, wherein occurrence of wrinkles is allowed in an initial stage of a deep-drawing, and releasing the pressing of the flat outermost edge when the deep-drawing progresses, wherein the wrinkles in the blank disappear while the blank pass through the tapered surface and the flat innermost edge surface.

12. The deep-drawing method according to claim 11, wherein an outer circumference portion of the blank is pressed and held even when the outer circumference portion passes through the tapered surface after the pressing of the flat outermost edge surface of the pressure pad is released.

* * * * *